United States Patent [19]

Lundblad

[11] 4,342,325

[45] Aug. 3, 1982

[54] DISPENSING APPARATUS

[76] Inventor: Leif J. I. Lundblad, Haradsvagen 102, S-141 41 Huddinge, Fed. Rep. of Germany

[21] Appl. No.: 137,189

[22] Filed: Apr. 4, 1980

Related U.S. Application Data

[63] Continuation-in-part of Ser. No. 950,108, Oct. 10, 1978, abandoned.

[30] Foreign Application Priority Data

Oct. 11, 1977 [SE] Sweden ..... 7711413

[51] Int. Cl.[3] ..... B65H 3/44

[52] U.S. Cl. ..... 133/1 R; 133/8 R; 194/DIG. 26; 271/3.1; 271/315

[58] Field of Search ..... 133/1 R, 1 A, 4 R, 8 R; 194/DIG.26; 271/3.1, 314, 315; 414/43

[56] References Cited

U.S. PATENT DOCUMENTS 3,965,913 6/1976 Tokura et al. ..... 133/8 R 4,017,004 4/1977 Onoe et al. ..... 194/DIG. 26

*Primary Examiner*—Joseph J. Rolla

*Attorney, Agent, or Firm*—Sughrue, Mion, Zinn, Macpeak & Seas

[57] ABSTRACT

An apparatus for dispensing sheet-like elements from a store of such elements to a receipt opening comprises an element-dispensing control circuit; first, second and third element-conveyors having respective drives electrically connected to said control circuit for controlling the respective operating sequences of said conveyor drives, said second conveyor being vertically movable towards and away from said third conveyor; and a counter for counting the number of elements dispensed from said store in response to an ordered number of said elements. The drive of the first conveyor is arranged, in cooperation with the control circuit, to dispense a given number of sheet-like elements to the second conveyor in dependence upon the absence of a previously dispensed bundle of elements on the second conveyor but independent of the presence or absence of previous conveyed bundle of elements in the receipt opening; and the drive of the second conveyor is arranged, in cooperation with the control circuit, to transfer the elements to the third conveyor in dependence upon the absence of a previously further conveyed bundle of elements in the receipt opening. In this way feeding of the sheet-like elements from said store to the receipt opening can commence during that time in which a previously conveyed bundle of elements still remains in the receipt opening.

3 Claims, 3 Drawing Figures

DISPENSING APPARATUS

Figure 1:
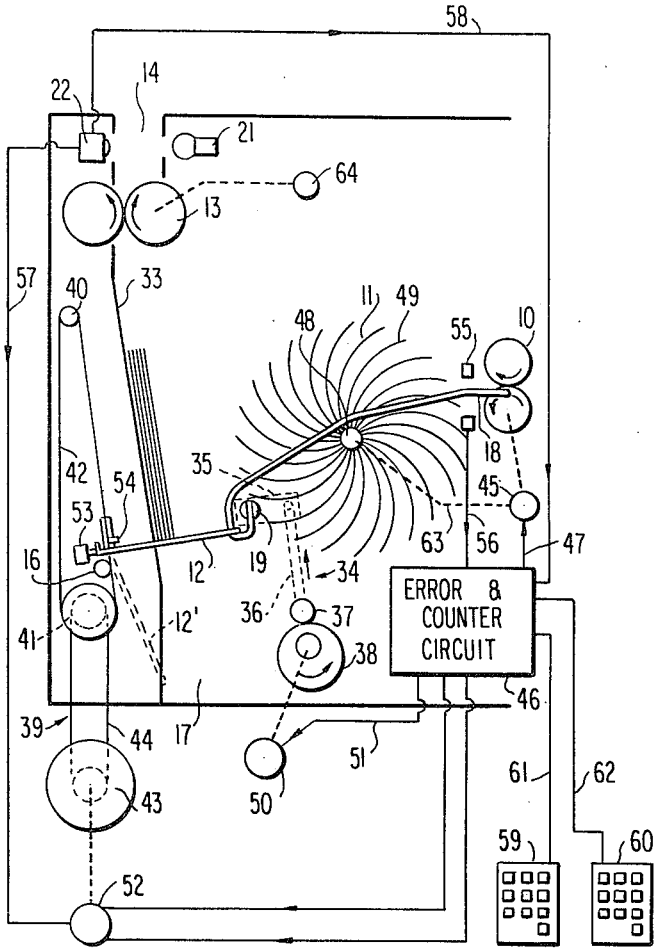

This application is a continuation-in-part of application Ser. No. 950,108, filed Oct. 10, 1978, now abandoned.

The present invention relates to a dispensing apparatus, and more particularly to an apparatus for transferring a given number of sheet-like elements from a store of such elements to a receipt opening.

Although dispensing apparatuses are known to the art in which one and the same apparatus is able to serve a plurality of receipt stations, there is a need for an apparatus which is able to serve one and the same receipt station in response to orders given by a plurality of separate customers.

Consequently, the object of the present invention is to provide an apparatus by means of which sheet-like elements, such as banknotes, can be dispensed in banks or postoffices to a receipt opening in a manner which is both positive and quick. By "in a positive manner" is meant here a dispensing operation which is correct both with regard to the number of banknotes dispensed and the sequence in time at which said banknotes are dispensed relative to an earlier initiated dispensing operation to be effected through the said receipt opening. By a "quick manner" is meant that the possibilities of preparing for a dispensing operation while earlier ordered dispensing operations are carried into effect and banknotes dispensed to said receipt opening are utilized to a maximum, i.e. any delay in the final stage of a dispensing operation is compensated for, as far as possible, by the preparation of a dispensing operation ordered at a later point of time.

This object is realized in accordance with the invention with an apparatus for feeding a given number of sheet-like elements from a store of such elements to a receipt opening, which comprises an element-dispensing control circuit; first, second and third element-conveying means having respective drive means electrically connected to said control circuit for controlling the respective operating sequences of said drive means, said second conveying means being vertically movable towards and away from said third conveying means; and counter means for counting the number of elements dispensed from said store in response to an ordered number of said elements, wherein the drive means of the first conveying means is arranged, in cooperation with said control means, to dispense a given number of sheet-like elements to the second conveying means in dependence upon the absence of a previously dispensed bundle of elements on the second conveying means but independent of the presence or absence of previous conveyed bundle of elements in the receipt opening; and wherein the drive means of the second conveying means is arranged, in cooperation with said control means, to transfer the elements to said third conveying means in dependence upon the absence of a previously further conveyed bundle of elements in the receipt opening, whereby feeding of said sheet-like elements from said store to said receipt opening can commence during that time in which a previously conveyed bundle of said elements still remains in the receipt opening, thereby enabling the dispensing procedure to be considerably expedited.

Figure 2:
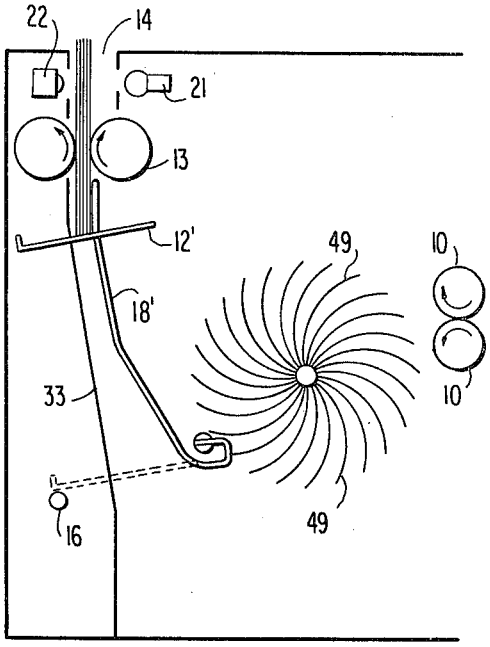
Figure 3:
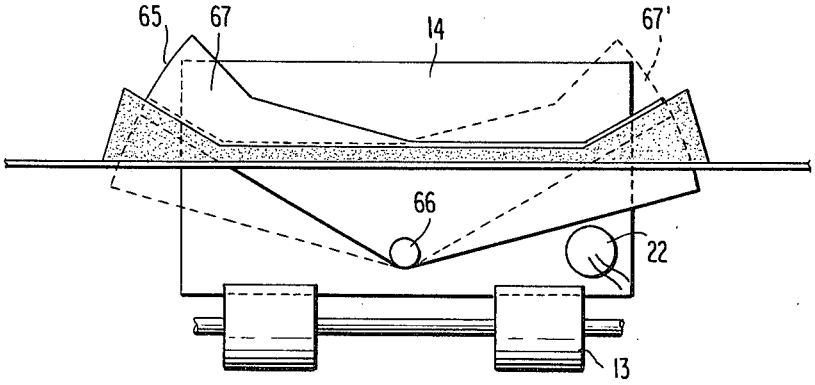

So that the invention will be more readily understood and further features thereof made apparent, an exemplary embodiment of the invention will now be described with reference to the accompanying schematic drawing, in which FIG. 1 illustrates a dispensing apparatus according to the invention in side view having a first and a second conveying means, said second conveying means being shown one position of its operation, FIG. 2 illustrates the apparatus of FIG. 1 in side view with the second conveying means located in another position of its operation, and FIG. 3 illustrates a device arranged to cooperate with the receipt opening of the apparatus shown in FIGS. 1 and 2 in a manner such as to enable banknotes to be withdrawn readily from only one side of said opening.

The apparatus illustrated in FIGS. 1 and 2 comprises three banknote-conveying sections, these being a first section comprising a pair of pick-up rolls 10 and a bladed pick-up device 11; a second section comprising a substantially vertically movable table 12 having a bottom surface onto which banknotes conveyed by the first conveying section are stacked, as shown at 15, on their short edges so as to extend vertically; and a third section comprising a pair of rollers 13 which are driven continuously in mutually opposite directions of rotation by a drive means 64, and which are located immediately beneath a receipt opening 14 and are arranged to grip the banknotes on the table 12 as said table is lifted vertically, to feed said banknotes into and through said opening 14, as illustrated in FIG. 2. The second conveying section, i.e. the table 12 is movable between a location of communication with the first conveying section 10, 11 (FIG. 1) and a location of communication with the third conveying section 13 (FIG. 2), the bundle of banknotes 15 being supported during upward movement of the table 12 by a support means 33 and a finger 18, in a manner described in more detail hereinafter. The table is also arranged for movement to a third location in which the table 12 is caused to swing down to a substantially vertical position, for a purpose hereinafter described.

The rollers 10 of the first conveying section are mounted for rotation on shafts which extend parallel with one another, at least one of which shafts is driven by a motor 45 which is connected to an error and counting circuit 46, which may be implemented with any of a number of well-known microprocessors through an electrical conductor 47, and also to the rotatable shaft of the wheel 11, through a conductor 63. The rollers are arranged to rotate so that for each revolution of said rollers one banknote at a time is dispensed from the store. Arranged in the path of the banknotes between the rollers 10 and the pick-up device 11 is a pair of mutually cooperating detecting means 55, which may have the form of opto sensors, and which are arranged to send a light-beam through a banknote being dispensed by the rollers 10. The sensors 55 are connected to error and counter circuit 46 through an electric conductor 56 and are arranged to emit an electric signal having a first value, e.g. a value of 10 volts, when a single note is being fed out through the rollers, and a second value, e.g. a value of 5 volts, when more than one note at a time is being dispensed.

The pick-up device 11 comprises at least one pair of bladed wheels mounted for rotation on a common shaft 48, which is driven by motor 45 simultaneously with the rollers 10. The spacing between the wheels shall be sufficient to reliably support and carry a banknote between mutually adjacent pairs of blades on said wheels. Each of the wheels comprises a multiplicity of curved blades 49 extending radially from the hub of said wheel, mutually adjacent ones of said blades being arranged to receive therebetween a banknote fed thereto by the rollers 10. It will be understood that, in response to instructions given to the apparatus (in a manner hereinafter described), an ordered number of banknotes is taken from the store of banknotes are and the banknotes fed one at a time by the rollers 10 into a respective space between adjacent ones of said blades, i.e. one space contains one banknote. The shape of the blades 49 is such that as the blades pass the table means 12, the banknotes present between said blades slide out onto said table.

The finger 18 forms part of a clearing and holding device which is pivotally mounted at 19 and which is intended to be swung up between the pair of wheels 11 in a manner to clear the wheels of the last of the given order of banknotes and to hold the banknotes in an ordered stack during their passage to the rollers 13. This position of the finger 18 is referenced 18' in FIG. 2.

As shown in FIG. 1, the finger 18 is raised and lowered by means of a respective link system, generally shown in ghost lines at 34 and comprising a first arm 35 which is fixedly connected at one end thereof to the pivot centre of the finger 18, while the other end of said arm is pivotally connected to a further, longer arm 36. Rotatably mounted on the free end of the arm 36 is a cam-follower 37, which is arranged to run around the periphery of an eccentric camming roller 38. The roller 38 is driven by a reversible motor 50, which is connected to the error and counter circuit 46 by an electric conductor 51.

It will be understood from this, and from FIG. 1, that when the camming roller is rotated in an anti-clockwise direction, the link arm 36 will be caused to move upwards by the cam-follower 37, thereby causing the finger 18 to pivot about its pivot axis, to the position shown in FIG. 2, in which it assists in guiding the banknotes towards the rollers 13, while holding said banknotes in a neat and compact stack. Preferably, the finger 18 is of a length such that in its raised position it terminates just short of rollers 13. Also, the end part of the finger 18 and that part of the support means 33 located in the vicinity of the rollers 13, are arranged so as to extend substantially parallel to one another in said raised position of the finger 18.

Vertical movement of the table 12 is effected by means of a drive arrangement generally shown at 39. In the illustrated embodiment, this drive arrangement comprises a first pulley 40 and a second, double pulley 41 arranged at a given distance beneath said first pulley. Arranged beneath the second pulley 41 is a third pulley 43 which is driven by a reversible motor 52. The pulley 43 drives the pulley 41 by means of a drive belt 44.

As will be seen from FIG. 1, the table 12 is attached at a location close to the end thereof remote from the roller 10 to the belt 42 in a manner which enables the table 12 to pivot in one direction only, i.e. to the substantially vertically depending position 12' shown in ghost lines, for a purpose hereinafter disclosed.

Arranged at said end of the table 12 is a counterweight 53 which assists in lifting the table 12 from the substantially vertical position 12' to its horizontal position. Pivoting of the table 12 in an upwards direction is prevented by a stop 54.

Adjacent the receipt opening 14 is a monitoring means 21–22, which in the shown embodiment comprises a lamp 21 and a photocell 22, and which is connected to the reversible motor 52 and to the error and counter circuit 46 through electrical conductors 57 and 58 respectively.

The illustrated currency dispensing apparatus has the following mode of operation.

When wishing to withdraw money from the store of banknotes (not shown), the sum desired is punched into one of the two illustrated keyboards 59,60, e.g. keyboard 59, through respective conductors 61 and 62. In response hereto, a signal is sent from the keyboard 59 through the conductor 61 to the error and counter circuit 46, in which said number is stored in a counter (not shown) incorporated therein, which counter may be of any suitable design. If the counter is in its zero state, a signal is then sent through conductor 47 to the motor 45, causing the wheel 11 and the rollers 10 to be rotated in response thereto.

As each note is dispensed through the rollers 10, the presence of said note is detected by the sensors 55 and a signal, e.g. corresponding to said first value of 10 volts, is sent to the circuit 46 through the conductor 56. Each of the notes dispensed is deposited between two mutually adjacent blades 49 on the wheel 11. As the wheel rotates, it reaches a position in which the banknote begins to slide out from between the blades 49. Upon further rotation of the wheel, this sliding of the banknote becomes progressively more pronounced, until said banknote protrudes from between the blades to an extent such that it bends down over the extremities of the blades and drops onto the table 12.

When the counter in the error and counter circuit 46 has counted down to zero, a signal is sent from said circuit to the motor 50 through the conductor 51, causing the camming roller 38 to rotate. A signal is also sent at the same time to the motor 52, which is programmed to rotate the pulley 43 after a brief delay of some milliseconds.

The motor 50 is arranged to rotate the roller 38 through one revolution, thereby to raise the finger 18 to the position 18'. As the finger rises it passes between the uppermost blades 49 on the wheel 11 and sweeps the banknote or banknotes remaining between respective blades into the stack of notes on the tables 12.

This lifting of the finger 18 can be arranged to take a time of some milliseconds, after which time the motor 52 causes the pulley 43 to rotate and the table 12, with the banknotes thereon, to be lifted towards the rollers 13. The distance from the table 12 in its FIG. 1 position to a position in which the banknotes can be gripped by rollers 13 can readily be calculated, taking into account the length of the banknotes, and thus the number of revolutions which the motor 52 must make to return the table to the FIG. 1 position can also be readily calculated. In the illustrated embodiment the motor 52 is reversed in response to a signal sent thereto on the conductor 57 by the detector means 21, 22 when the beam therebetween is broken by the bundle of banknotes passing to the opening 14.

This reversing of the motor 52 is continued until the beam from lamp 21 again impinges on the photo cell 22, i.e. until the banknotes are removed from the opening 14, thereby preventing the table 12 from being lifted towards said opening until the opening is clear. Subsequent to having rotated the requisite number of revolutions, to return the table 12 to the FIG. 1 position, a signal is sent from said motor to the circuit 46, indicating that the table is in position for a further bundling operation. When the opening is clear, the reversing signal to the motor 52 ceases, allowing the motor to be activated by an appropriate signal from the circuit 46 in respect of the next transaction in line.

If, for some reason or other, more than one banknote at a time is dispensed through the rollers 10, this will be detected by the sensors 55 and an error signal having said second value of, e.g., 5 volts is sent to the error and counting circuit 46 through the conductor 56. The counter continues to count down to zero, and when having counted down to zero an error signal is sent to the motor 52 which, in response thereto, rotates the pulley 43 clockwise through a given small angle, so as to force the outer end of the table 12 against the stop 16 and to cause said table to be swung down to the position shown in ghost lines and the banknotes resting on said table to slide or fall down into a suitable receptacle. The motor 52 is suitably programmed so that the pivoting force is only applied to the table means for a relatively short period of time, again some few milliseconds, whereafter the motor stops and the table is returned to its FIG. 1 position by means of the counter weight 53. As the motor 52 stops, a signal indicating that the error procedure has been completed is sent from the motor to the circuit 46, which in response thereto reintroduces the transaction into the counter of said circuit and repeats said transaction.

As will be understood from the aforegoing, the apparatus is so constructed that no banknotes can be dispensed by the pick-up rollers 10 to the table 12 until the table has returned to the FIG. 1 position. Neither can the table be lifted towards the third conveying means until the opening 14 is clear, although banknotes may still be dispensed to said table from the first conveying means even though the opening 14 is blocked by banknotes from a preceeding transaction.

The speed at which the apparatus operates and its reliability in operation enables it to service two customers or two bank clerks at the same time and through the same receipt opening 14. However, in order to distinguish between orders and in order to ensure the correct customer or client is serviced, the receipt opening 14 is provided with a shielding device 65 which automatically covers one side of the opening 14 whilst leaving the other side free. The device 65 is pivotally arranged on a horizontal shaft 66, such as to provide free access to the receipt opening from one side thereof (e.g. from the right) and to prevent removal from the receipt opening from the other side thereof (from the left).

The device 65 is arranged to take one of two possible positions, namely the position 67 shown in full lines or the position 67' shown in ghost lines, depending from which side (left or right) a bundle of notes is to be taken in response to an order. The device 65 is brought automatically to its correct position (position 67 or position 67') by means not shown, when said vertical upward movement of said conveying means 12 is initiated.

The apparatus is suitably constructed in a manner such that if a customer should forget to remove the banknotes which he has ordered and which are thus available in the receipt opening 14, the device 18 and the conveying means 12 are caused to adopt positions 18' and 12' respectively, as shown in FIG. 2, and the third conveying means is caused to move in a direction opposite to the normal movement, whereby the bundle of notes is returned to the conveying means 12 and then conveyed by said means 12 to a position shown in FIG. 1, and then further to the space 17 (the conveying means 12 takes the position 12'). In this way an unauthorized person (the next customer) is prevented from removing said bundle of notes and the forgetful customer can recover his property upon reporting the matter.

I claim:

1. An apparatus for feeding a given number of sheet-like elements from a store of such elements to a receipt opening, comprising: an element-dispensing control means; first, second and third element-conveying means having respective drive means electrically connected to said control means for controlling the respective operating sequences of said drive means, said second conveying means being movable towards and away from said third conveying means; and counter means for counting the number of elements dispensed from said store in response to an ordered number of said elements, wherein the drive means of the first conveying means is arranged, in cooperation with said control means, to dispense a given number of sheet-like elements to the second conveying means in dependence upon the absence of a previously dispensed bundle of elements on the second conveying means but independent of the presence or absence of a previous conveyed bundle of elements in the receipt opening; and wherein the drive means of the second conveying means is arranged, in cooperation with said control means, to transfer the elements to said third conveying means in dependence upon the absence of a previously further conveyed bundle of elements in the receipt opening, whereby feeding of said sheet-like elements from said store to said second conveying means can commence during that time in which a previously conveyed bundle of said elements still remains in the receipt opening, thereby enabling the dispensing procedure to be considerably expedited.

2. An apparatus according to claim 1, wherein the second conveying means comprises a lifting device for lifting a dispensed given number of banknotes vertically upwards to the third conveying means.

3. An apparatus according to claim 1 or 2, characterized by a sleeve located adjacent the upper part of the receipt opening and being pivotally arranged on a horizontal shaft, said sleeve being arranged to provide free access to the receipt opening from one side thereof and to prevent removal from the receipt opening from the other side thereof, and also arranged, in conjunction with the function of the second conveying means to take any one of two possible positions in dependence upon from which side a bundle of elements shall be taken in response to an order for the dispensement of said bundle.

* * * * *